US009082376B1

(12) United States Patent
Takegawa et al.

(10) Patent No.: US 9,082,376 B1
(45) Date of Patent: Jul. 14, 2015

(54) SNARE DRUM STRAINER WITH LOCKING ASSEMBLY

(71) Applicant: PEARL MUSICAL INSTRUMENT CO., Chiba (JP)

(72) Inventors: Akito Takegawa, Chiba (JP); Katsuhiro Momose, Chiba (JP)

(73) Assignee: Pearl Music Instrument Co., Chiba (JP)

( * ) Notice: Subject to any disclaimer, the term of this patent is extended or adjusted under 35 U.S.C. 154(b) by 0 days.

(21) Appl. No.: 14/603,950

(22) Filed: Jan. 23, 2015

Related U.S. Application Data

(60) Provisional application No. 61/936,176, filed on Feb. 5, 2014, provisional application No. 61/930,703, filed on Jan. 23, 2014.

(51) Int. Cl.
*G10D 13/02* (2006.01)

(52) U.S. Cl.
CPC ..... *G10D 13/025* (2013.01)

(58) Field of Classification Search
CPC ... G10D 13/02; G10D 13/021; G10D 13/025; G10D 13/026; G10D 13/00
USPC ..... 84/411 R, 415
See application file for complete search history.

(56) References Cited

U.S. PATENT DOCUMENTS

| | | | | |
|---|---|---|---|---|
| 5,557,053 | A | 9/1996 | Nickel | |
| 6,492,583 | B1 | 12/2002 | Wilkey | |
| 6,891,098 | B1 | 5/2005 | Lombardi | |
| 7,262,355 | B2 | 8/2007 | Hagiwara et al. | |
| 7,439,433 | B1 | 10/2008 | Hsieh | |
| 7,498,501 | B1 | 3/2009 | Hsieh | |
| 7,745,712 | B2 | 6/2010 | Dunnett | |
| 7,977,558 | B2 | 7/2011 | Nakata et al. | |
| 8,017,846 | B2 | 9/2011 | Miyajima | |
| 2005/0188818 | A1* | 9/2005 | Okamoto | 84/415 |
| 2007/0079686 | A1 | 4/2007 | Hsieh | |
| 2008/0264234 | A1 | 10/2008 | Hsieh | |

* cited by examiner

*Primary Examiner* — Kimberly Lockett
(74) *Attorney, Agent, or Firm* — Manelli Selter PLLC; Edward J. Stemberger

(57) ABSTRACT

A snare assembly tensioning and locking mechanism for holding snare wires in either a contact or non-contact position against a bottom drum head of a snare drum. The mechanism uses a lever mounted horseshoe shaped clip including surface bumps or protrusions that, when the lever is in an upward and locked position, engage a set of complementary notches on a surrounding peripheral surface of a snare wire tension adjusting knob. In alternate embodiments, the locking lever may pivot toward the drum or in a direction tangential to the drum. In this manner, the snare wires are held in tension against inadvertent loosening of the tension adjusting knob while the drum is played.

20 Claims, 9 Drawing Sheets

SNARE DRUM STRAINER WITH LOCKING ASSEMBLY

CROSS-REFERENCE TO RELATED APPLICATIONS AND CLAIM TO PRIORITY

This application claims priority to provisional application Ser. No. 61/930,703 filed on Jan. 23, 2014, and provisional application Ser. No. 61/936,176 filed on Feb. 5, 2014, the disclosures of which are incorporated herein by reference and to which priority is claimed.

BACKGROUND OF THE INVENTION

1. Field of the Invention

The present invention relates to a strainer for supporting a snare assembly end of a snare drum and for switching a snare assembly between contact/noncontact states relative to a drumhead; and, a snare assembly holding structure for supporting the snare assembly end on the side of a drum shell body.

2. Description of Related Art

A snare drum comprises a top-side drumhead and a bottom-side drumhead disposed on opposite ends of a shell body, having hoops interposed there between, respectively. Further, a plurality of head adjustment devices, for adjusting tension of the drumheads, are disposed at equal angular intervals along the periphery, so as to connect the top-side hoop and the bottom-side hoop. Snare strainers located in opposition at opposite positions on the shell body (180 degrees apart) hold a snare assembly against the drum. The snare assembly is made up of a plurality of snare wires laid across and in contact with the bottom-side drum head. The assembly also operates such that the snare wires can be switched between a contact state and a noncontact state with respect to the bottom-side drumhead. At least one of the pair of strainers is a strainer equipped with a switch or lever mechanism that allows the snare assembly to switch between the contact/noncontact states by moving up and down, i.e., longitudinally with respect to the axis of the drum, with respect to the one end of the snare assembly being held. The other may also be a similar strainer equipped with a switch mechanism, or it may be a fixed type strainer without such a switch mechanism.

What has conventionally been provided on such a strainer, equipped with a switch mechanism for contact/noncontact conversion, are components such as: a base element fixed at the exterior circumferential surface of a shell body; a snare assembly holding element mounted on the base element so as to be freely movable upward and downward; a switch mechanism that moves forward and backward the snare assembly holding element relative to the base element so as to bring the movable end of the snare assembly into contact or out of contact with a bottom-side drumhead; and a tension adjustment screw that similarly moves forward and backward with the snare assembly holding element relative to the base element so as to fine-tune the tension of the snare assembly.

However, in use, beating the drum causes the timbre to change because vibrations cause the tension adjustment screw to perceptibly loosen, thus allowing the snare to become somewhat slack. As a result the snare tension head must be readjusted when performing to ensure high sound quality. However, this adjustment may impact sound quality and distract a player's concentration and may cause mistiming, missed cues or the like.

SUMMARY OF THE INVENTION

The present invention provides a strainer equipped with a switch mechanism which has a simple structure, and hence achieves a reduction in costs, that can be easily and reliably operated with a small force, with little backlash due to wear or the like, and that maintains excellent operation feel without putting an undue burden on the snare assembly. The present invention further provides a snare tension locking assembly to prevent loosening of the snare assembly.

The present invention features a horseshoe-shaped clip that clips onto the cylindrically-shaped tension knob to keep both the lever secure while playing, and the tension knob secure from rotation. Bumps or protrusions on the inner surrounding surface of the horseshoe clip engage complementary exterior notches around the outer surface of the tension knob, thus preventing the tension knob from spinning or rotating while the drum is being played. In accord with the invention, the snare is securely fastened in position against the bottom-side drum head and the tension of the wires themselves is prevented from being altered.

DETAILED DESCRIPTION OF THE PREFERRED EMBODIMENT(S)

Figure 1:
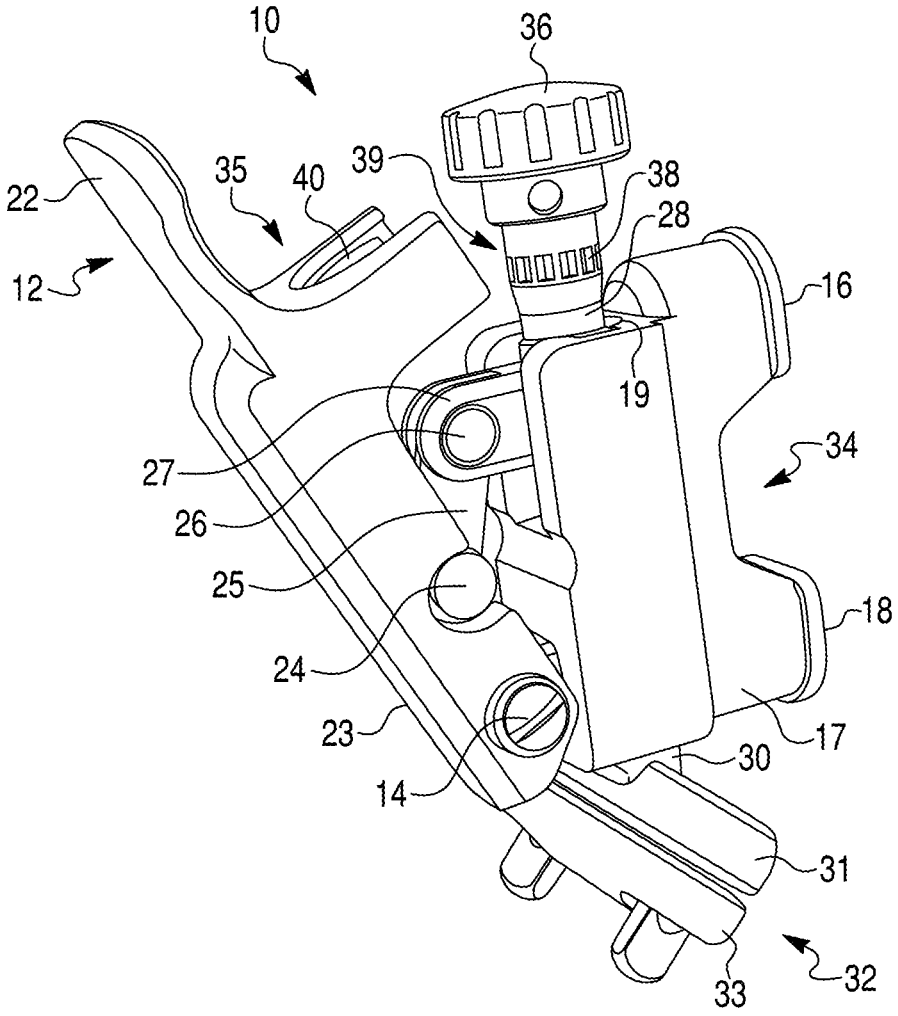
FIG. 1 is a perspective view of a locking lever and tension clip according to the present invention showing the lever pivoting radially towards the drum center.

FIGS. 1-6 illustrate a snare strainer according to an exemplary embodiment of the present invention. The snare strainer assembly 10 includes a frame assembly 34, a snare wire assembly holder 32, a tension rod 28, a snare wire adjusting knob 36, a lever 12, and a restricting element 40.

The frame assembly 34 is configured to pivotally support the lever 12 and allow the snare strainer assembly 10 to be affixed to a sidewall of a drum (not shown). The frame assembly 34 comprises a frame assembly housing 17, drum attachment portions 16, 18, and a bore 19 formed in the frame assembly housing 17. The drum attachment portions 16, 18 extend from the frame assembly housing 17 toward the drum and drum attachment portion 16 is spaced from drum attachment portion 18. In an exemplary embodiment, the drum attachment portions 16, 18 are configured to receive a fastener such as a screw, bolt, nail, or other mechanical fastener extending from the drum for securing the frame assembly 17 to the drum. Alternatively, the drum attachment portions 16, 18 can be attached to a drum sidewall using adhesive or other chemical bonding agents. The drum attachment portions 16, 18 may be made of a relatively soft polymer material, such as rubber, in order to not mar the surface of the drum and to avoid unwanted vibrations.

Figure 2:
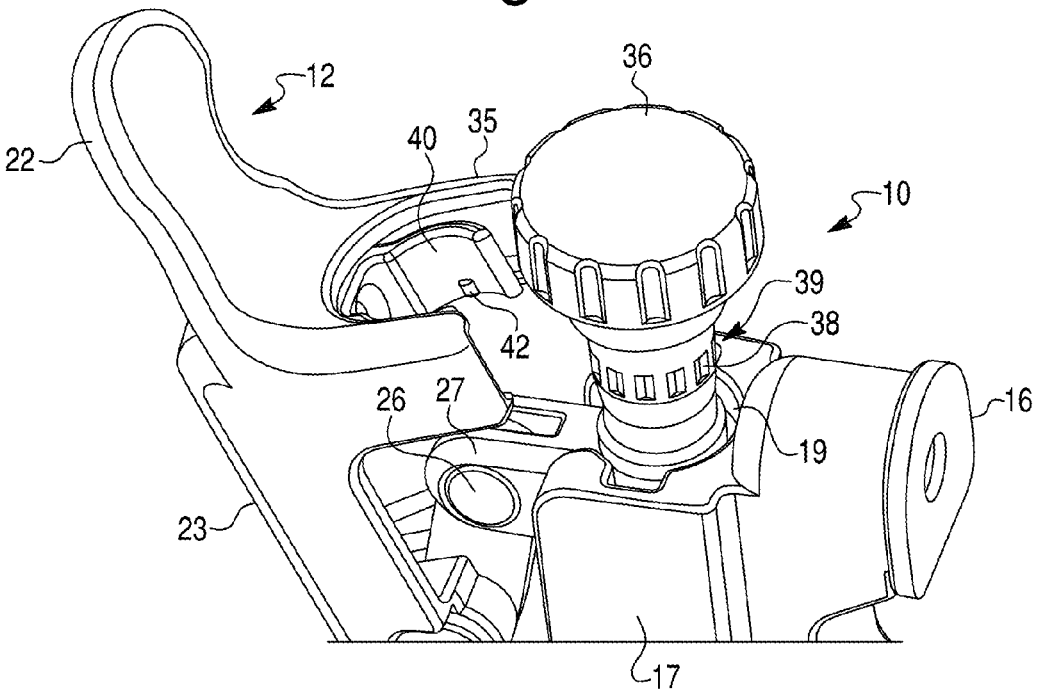
FIG. 2 is a perspective view of a snare lever and tension lock in accord with the present invention. The locking lever pivots in a radial direction towards the center of the drum.

The frame assembly housing 17 further includes a collar 27 that extends from the frame assembly housing 17. As best illustrated in FIG. 2, collar 27 includes two substantially parallel plates extending from the frame assembly housing 17. In an exemplary embodiment, intermediate strut 25 is positioned between the two substantially parallel plates of the collar 27 and a pivot pin 26 couples the strut 25 to the collar 27 to pivotally mount the lever 12 to the frame assembly housing 17.

A snare wire assembly holder 32 is coupled to a lower end of the frame assembly housing 17. The snare wire assembly holder 32 includes a first snare wire holding element plate 31 and a second snare wire holding element plate 33. In an exemplary embodiment, as best illustrated in FIG. 1, snare wires are disposed between the first snare wire holding element plate 31 and the second snare wire holding element plate 33 where tension is applied to the snare wires based on a force applied by the tension rod 28 to the first snare wire holding element plate 31. For example, when the snare wire adjusting knob 36 is turned to allow the lower end 30 of the tension rod 28 to apply more force to the first snare wire holding element plate 31, the tension on the snare wires increases and when the snare wire adjusting knob 36 is turned to reduce the amount of force applied to the first snare wire holding element plate 31, the tension on the snare wires decreases causing the snare wires to become more slack.

A tension rod 28 modifies tension applied to the snare wires. The tension rod 28 includes a snare wire adjusting knob 36, a threaded portion, and a restricting element coupling surface 39 disposed between the snare wire adjusting knob 36 and the threaded portion of the tension rod 28. The snare wire adjusting knob 36 may be articulated or rotated in both a clockwise and counter-clockwise direction. In an exemplary embodiment, a user turns the knob 36 clockwise or counter-clockwise to tighten or loosen tension on the snare wires connecting to holder 32 as described above. The threaded portion of the tension rod 28 is disposed in the bore 19 formed in the frame assembly housing 17. The restricting element coupling surface 39 can include notches 38 formed on an outer surface of the tension rod. In an exemplary embodiment, the notches can be equally spaced around the circumference of the tension rod 28. While the notches 38 are illustrated as being angularly inwardly projecting and intersecting at an apex, those skilled in the art will appreciate that the notches 38 can have any configuration, including projections extending from the tension rod. In that event, the horseshoe-shaped clip 40 would have notches to engage the projections.

Lever 12 is pivotally mounted to the frame assembly 17. Lever 12 includes a lever body comprising an end 22 and an intermediary portion 23 where the end 22 and the intermediary portion 23 are in the substantially same plane. Lever 12 further includes a projection 35 that extends substantially perpendicular to the lever body. Lever 12 is pivotally mounted to the frame assembly through pivot pin 14 disposed at the lower end of the lever 12. In addition, as described above, lever 12 is further pivotally mounted to the frame assembly 17 through intermediary pivot pin 24 where shaft 25 is coupled between collar 27 projecting from the frame assembly and the lever 12 via the intermediary pivot pin 24 and the pivot pin 26.

Figure 3:
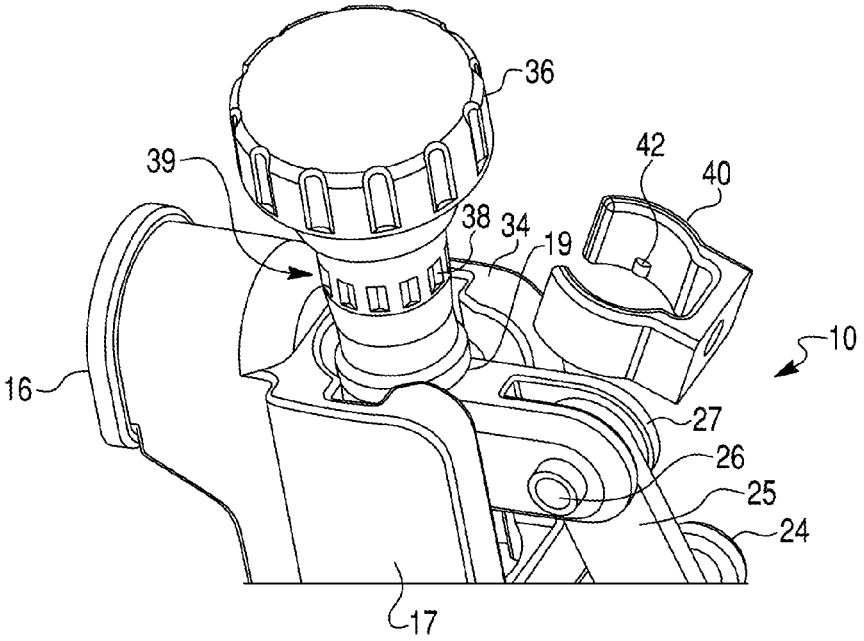
FIG. 3 is a perspective view illustrating the horseshoe shaped clip of the subject invention disassociated from its surrounding lever assembly. The inner surface bumps that engage with the exterior tension knob notches are shown.
Figure 4:
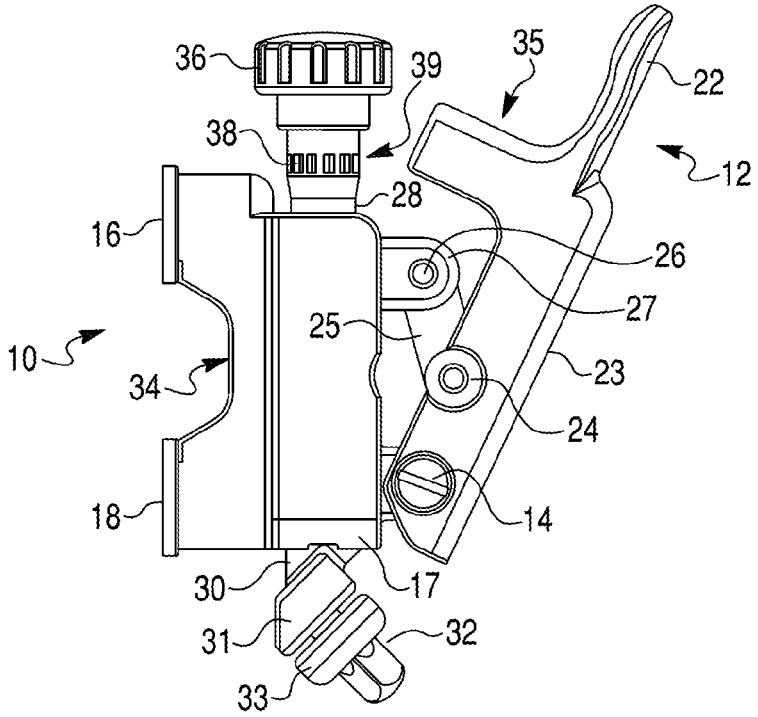
FIG. 4 is a side elevational view of a snare lever and tension lock of the present invention in a disengaged position.
Figure 5:
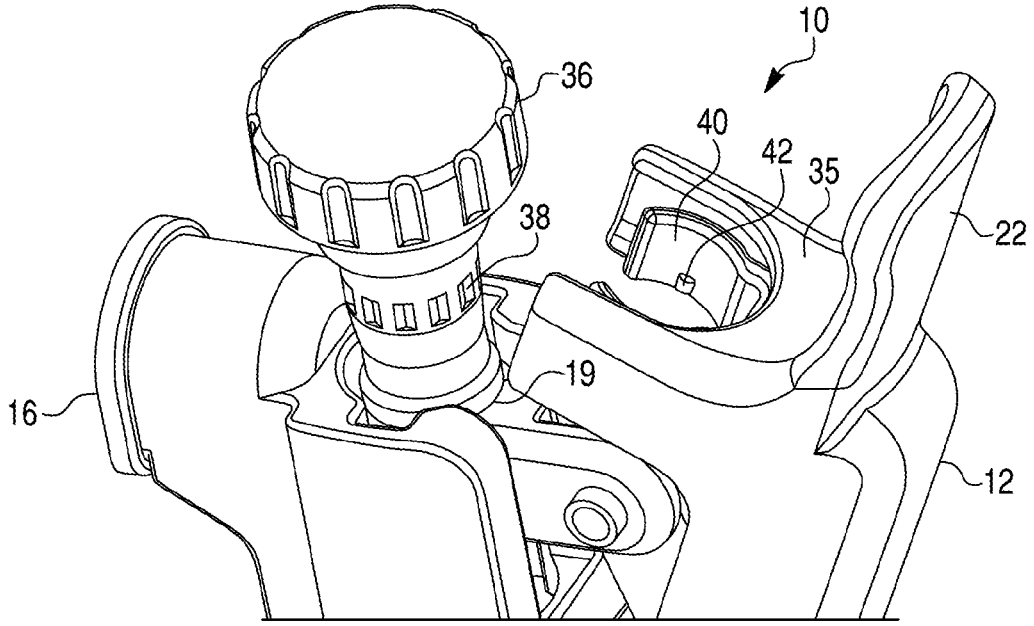
FIG. 5 is a perspective view illustrating the horseshoe shaped clip in association with the surrounding locking lever. The exterior notches of the tension knob are also shown.
Figure 6:
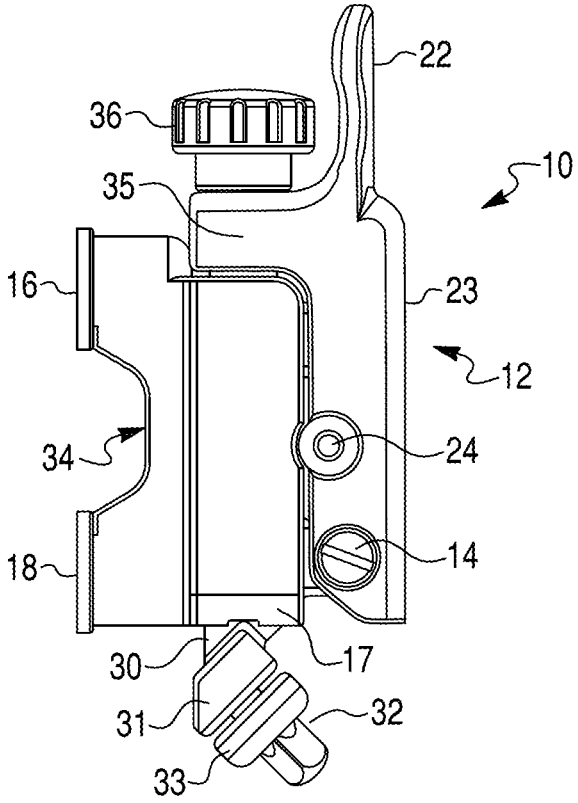
FIG. 6 is a side elevational view illustrating the lever for urging the snare assembly into contact with the bottom-side drum head in a locked contact position; the horseshoe clip is engaged with the tension knob in this position as well.

A restricting element 40 prevents the tension rod 28 from inadvertently turning or loosening as the drum is being played. The restricting element 40 engages with the restricting element coupling surface 39 formed on the tension rod 28. As best illustrated in FIG. 3, the restricting element 40 can partially surround the outer surface of the tension rod 28. One or more projections 42 are formed on a surface of the restricting element 40 where the projections 42 each engage a notch 38 formed in an outer surface of the tension rod 28. While only one projection 42 is illustrated in FIG. 3, one of ordinary skill in the art would recognize that any number of projections 42 can extend from the surface of the restriction element 40. In an exemplary embodiment, the restricting element 40 is a horseshoe-shaped clip. While the Figures illustrate notches 38 formed in tension rod 28 and projections 42 formed in restricting element 40, the opposite configuration could be utilized provided that the restricting element 40 cooperates with tension rod 28 to prevent unwanted rotation of rod 28. One advantage of projections 42 and notches 38 is that they provide an audible cue to the user and also provide tactile feedback, thus facilitating applying appropriate tension to the snare wires.

In operation, a user can adjust the force applied to the snare wire assembly 30 by turning the knob 36 of the tension rod 28 in a clockwise or counter-clockwise direction. When the desired tension is reached, lever 12 is moved into a locked position such that the restricting element 40, equipped with inner surface bumps or protrusions 42, engages the restricting element coupling surface 39 where the protrusions 42 engage the peripheral notches 38 formed in the outer surface of the tension rod 28. In this manner, the tension rod 28 is prevented from inadvertent turning or loosening while an associated drum is being played.

FIGS. 7-11 illustrate a snare strainer according to another exemplary embodiment of the present invention. The snare strainer assembly 110 includes a frame assembly 134, a snare wire assembly holder 132, a tension rod 128, a snare wire adjusting knob 136, a lever 112, and a restricting element 140.

Figure 8:
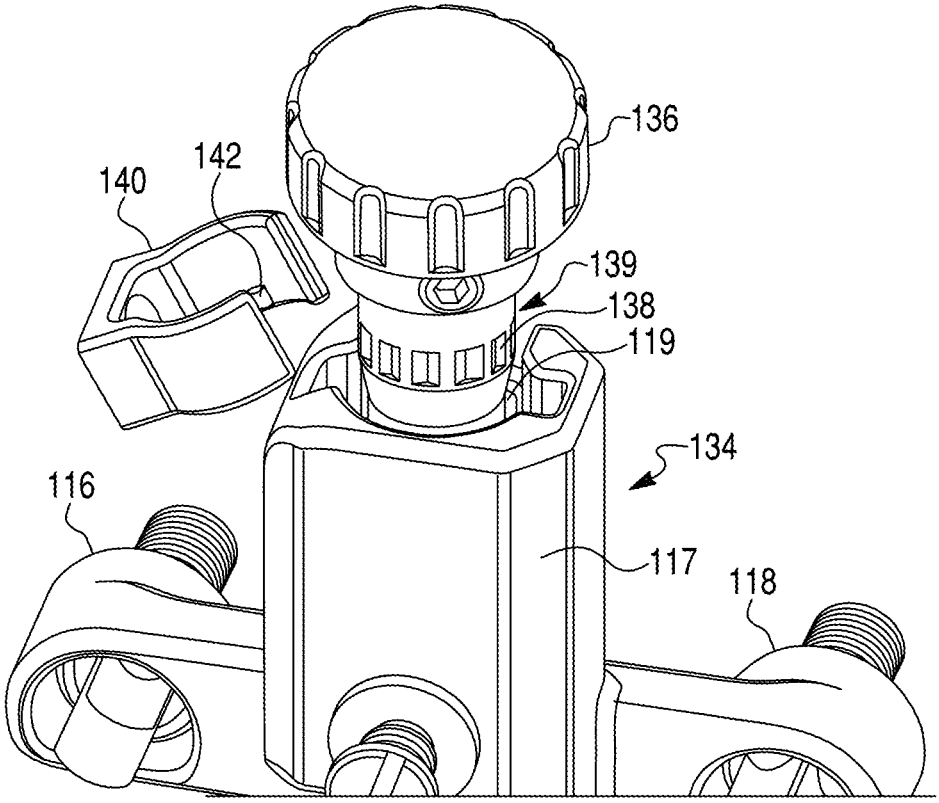
FIG. 8 is a fragmentary perspective view of an alternative embodiment of a snare lever and tension lock in accord with the present invention. The locking lever is shown pivoting in a tangential direction to the drum body.

The frame assembly 134 is configured to pivotally support the lever 112 and allow the snare strainer assembly 110 to be affixed to a sidewall of a drum (not shown). The frame assembly 134 comprises a frame assembly housing 117, drum attachment portions 116, 118, and a bore 119 formed in the frame assembly housing 117. The drum attachment portions 116, 118 extend from the frame assembly housing 117 where drum attachment portion 116 is spaced away from drum attachment portion 118. In an exemplary embodiment, as best illustrated in FIG. 8, the drum attachment portions 116, 118 are configured to receive a fastener such as a screw, bolt, nail, or other mechanical fastener extending from the drum for securing the frame assembly housing 117 to the drum. Alternatively, the drum attachment portions 116, 118 can be attached to a drum sidewall using adhesive or other chemical bonding agents. The drum attachment portions 116, 118 may be made of a relatively soft polymer material, such as rubber, in order to not mar the surface of the drum and to avoid unwanted vibrations.

Figure 7:
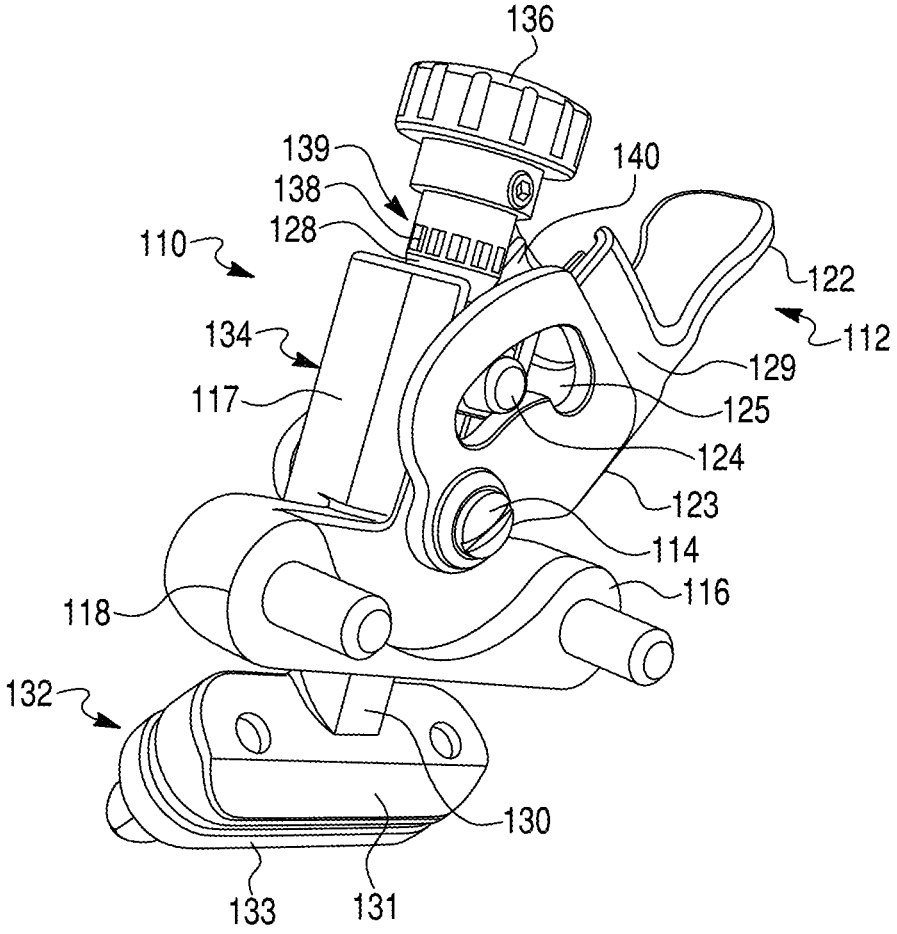
FIG. 7 is a perspective view of a locking lever and tension clip according to the present invention showing the lever pivoting tangentially with respect to the drum body.
Figure 9:
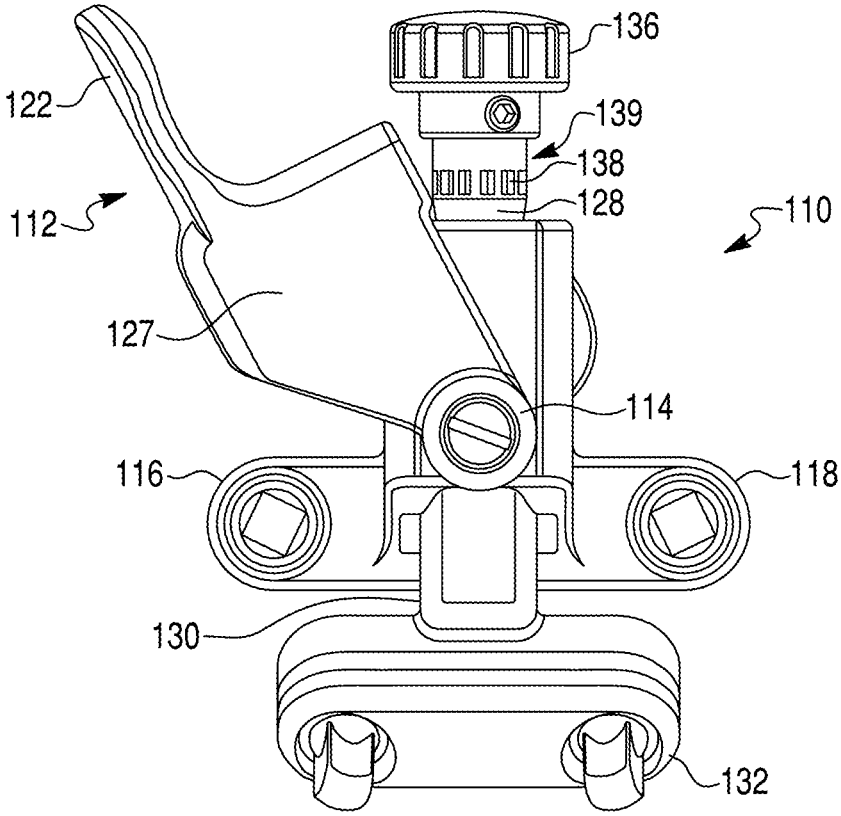
FIG. 9 is a side elevational view illustrating the locking lever in a disengaged position wherein the lever pivots in a direction tangential to the drum body.
Figure 10:
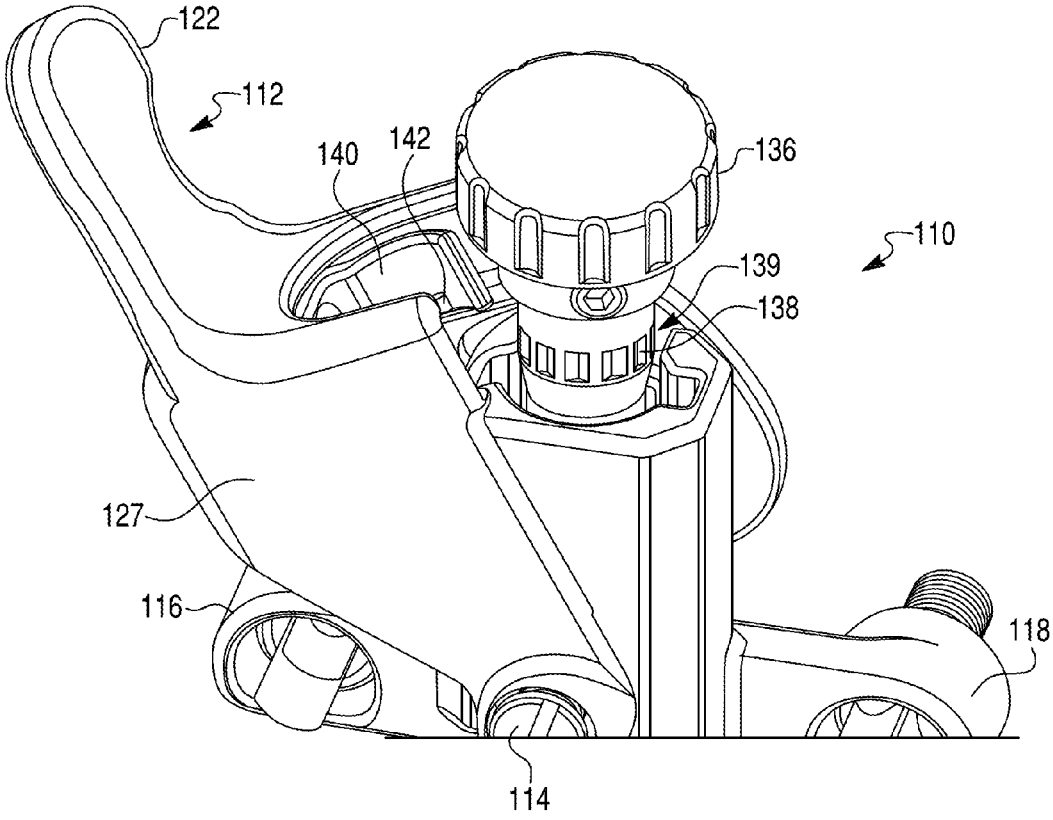
FIG. 10 is a fragmentary perspective view illustrating the horseshoe shaped clip equipped with bumps along its surrounding inner surface; the bumps engaging complementary notches around the exterior surface of the tension knob.
Figure 11:
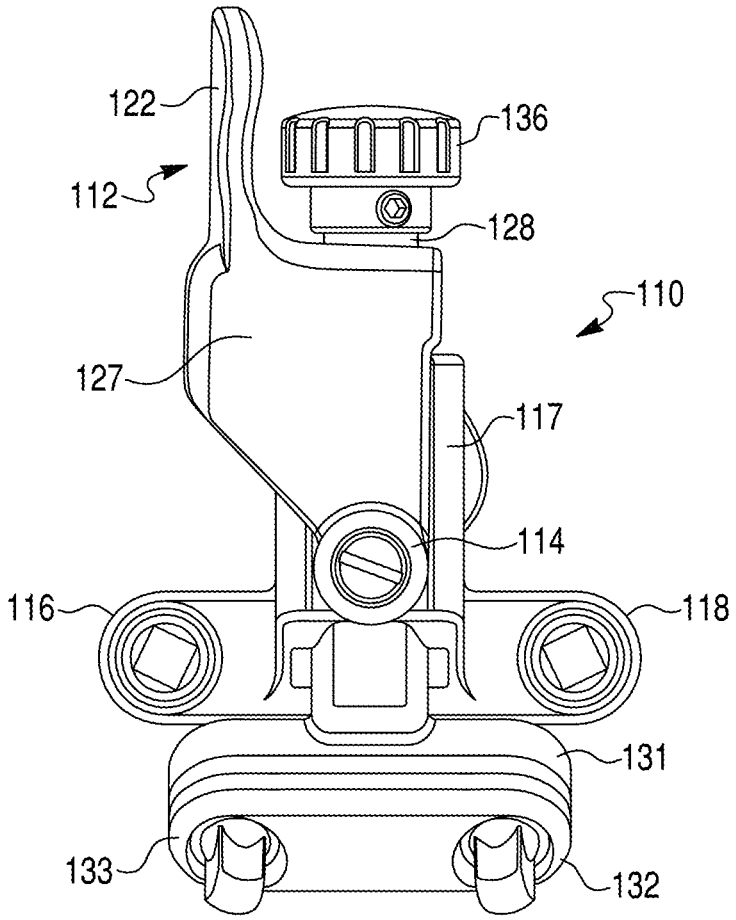
FIG. 11 is a side elevational view illustrating the locking tension lever of the alternative embodiment of the present invention in the fully engaged "on" position wherein the snare wire assembly is held in surface contact with the bottom-side drum head.

As best illustrated in FIGS. 7, 9, and 11, a snare wire assembly holder 132 is coupled to a lower end of the frame assembly housing 117. The snare wire assembly holder 132 includes a first snare wire holding element plate 131 and a second snare wire holding element plate 133. In an exemplary embodiment, snare wires are disposed between the first snare wire holding element plate 131 and the second snare wire holding element plate 133 where tension is applied to the snare wires based on a force applied by a lower end 130 of the tension rod 128 to the first snare wire holding element plate 131. For example, when the snare wire adjusting knob 136 is turned to allow the lower end 130 of the tension rod 128 to apply more force to the first snare wire holding element plate 131, the tension on the snare wires increases and when the snare wire adjusting knob 136 is turned to reduce the amount of force applied to the first snare wire holding element plate 131, the tension on the snare wires decreases causing the snare wires to become more slack.

A tension rod 128 is configured to modify tension applied to the snare wires. The tension rod 128 includes a snare wire adjusting knob 136, a threaded portion, and a restricting element coupling surface 139 disposed between the snare wire adjusting knob 136 and the threaded portion of the tension rod 128. The snare wire adjusting knob 136 is configured to be articulated or rotated in a clockwise and counter-clockwise direction. In an exemplary embodiment, a user turns the knob 136 clockwise or counter-clockwise to tighten or loosen tension on the snare wires connected to holder 132 as described above. The threaded portion of the tension rod 128 is disposed in the bore 119 formed in the frame assembly housing 117. The restricting element coupling surface 139 can include notches 138 formed on an outer surface of the tension rod 128. In an exemplary embodiment, the notches 138 can be equally spaced around the circumference of the tension rod 128.

Lever 112 is pivotally mounted to the frame assembly. Lever 112 includes a lever body comprising an end 122, a coupling portion 123 that including an actuating slot 125, and a side portion 127. Lever 112 further includes a projection 129 that extends substantially perpendicular to the lever body where in an exemplary embodiment the coupling portion 123 and the side portion 127 are coupled with the projection 129. Lever 112 is pivotally mounted to the frame assembly through pivot pins 114 disposed at both sides of the lower end of the lever 112. A coupling pin 124 engages with the actuation slot 125 to allow the lever 112 to be pivotally mounted to the frame housing. The actuation slot 125 further includes a recess where the coupling pin 124 resides when the lever is in a locked position.

A restricting element 140 is configured to prevent the tension rod 128 from inadvertently turning or loosening as the drum is being played. The restricting element 140 engages with the restricting element coupling surface 139 formed on the tension rod 128. The restricting element 140 partially surrounds the outer surface of the tension rod 128. One or more projections 142 are formed on a surface of the restricting element 140 where the projections 142 each engage a notch 138 formed in an outer surface of the tension rod 128. While only one projection 142 is illustrated in FIG. 8, one of ordinary skill in the art would recognize that any number of projections 142 can extend from the surface of the restricting element 140. In an exemplary embodiment, the restricting element 140 is a horseshoe-shaped clip.

In operation, a user adjusts the force applied to the snare wire assembly 130 by turning the knob 136 of the tension rod 128 in a clockwise or counter-clockwise direction. When the desired tension is reached, lever 112 is moved into a locked position such that the coupling pin 124 rests within the recess of the actuating slot 125 and the restricting element 140, equipped with inner surface bumps or protrusions 142, engages the restricting element coupling surface 139 where the protrusions 142 engage the peripheral notches 138 formed in the outer surface of the tension rod 128. In this manner, the tension rod 128 is prevented from inadvertent turning or loosening while an associated drum is being played.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

The invention claimed is:

1. A snare strainer for a snare drum, comprising:

a frame assembly comprising a frame assembly housing, a drum attachment portion extending from the frame assembly housing, and a bore formed in the frame assembly housing;

a snare wire assembly holder coupled to a lower end of the frame assembly housing, wherein the snare wire assembly holder is configured to engage snare wires;

a tension rod disposed within the bore formed in the frame assembly housing, wherein the tension rod is configured to modify tension applied to the snare wires and a plurality of notches are formed in an outer surface of the tension rod;

an adjusting knob coupled to an upper portion of the tension rod;

a lever pivotally mounted to the frame assembly, wherein the lever comprises a lever body and a projection that extends substantially perpendicular to the lever body; and a restricting element operably associate with the projection of the lever, wherein the fastening element engages with the notches formed in an outer surface of the adjusting knob.

2. The snare strainer of claim 1, wherein the drum attachment portion comprises a first attachment point and a second attachment point spaced away from the first attachment point.

3. The snare strainer of claim 1, wherein the snare wire assembly holder comprises a first holding element plate and a second holding element plate and the snare wires are engaged between the first holding element plate and the second holding element plate of the snare wire assembly holder.

4. The snare strainer of claim 1, wherein the tension rod comprises a threaded portion that engages within the bore formed in the frame assembly housing.

5. The snare strainer of claim 1, wherein the adjusting knob is configured to rotate the tension rod in both a clockwise and counter-clockwise direction.

6. The snare strainer of claim 1, wherein the frame assembly further includes a collar extending from the frame assembly housing and the lever is pivotally mounted to the frame assembly through a strut coupled between the collar and the lever body.

7. The snare strainer of claim 6, wherein the lever is further pivotally mounted to the frame assembly through a pin coupled to the frame assembly housing, where the pin is disposed below the collar.

8. The snare strainer of claim 1, wherein the lever body comprises an actuating slot and an intermediate pivot coupled to the frame assembly housing is engaged within the actuating slot to pivotally mount the lever to the frame assembly.

9. The snare strainer of claim 1, wherein the fastening element further comprises projections and the projections engage with the notches formed in the outer surface of the adjusting knob.

10. The snare strainer of claim 1, wherein the fastening element partially surrounds the outer surface of the adjusting knob.

11. The snare strainer of claim 10, wherein the fastening element is a horseshoe clip.

12. A snare strainer for a snare drum, comprising:

a frame assembly comprising a frame assembly housing, a drum attachment portion extending from the frame assembly housing, and a bore formed in the frame assembly housing;

a snare wire assembly holder coupled to a lower end of the frame assembly housing, wherein the snare wire assembly holder is configured to engage snare wires;

a tension rod rotatably disposed within the bore, wherein the tension rod is rotatable to modify tension applied to the snare wires and a plurality of first engagement surfaces are formed about an outer surface of the tension rod;

an adjusting knob coupled to an upper portion of the tension rod;

a lever pivotally mounted to the frame assembly, wherein the lever comprises a lever body and a plurality of second engagement surfaces disposed about the lever and shaped to complement the first engagement surfaces; and a restricting element operably associate with the projection of the lever, wherein the first engagement surfaces engage the second engagement surfaces and thereby restrain rotation of the tension rod.

13. The snare strainer of claim 12, wherein the first engagement surfaces extend into the tension rod and the second engagement surfaces protrude from the restricting element.

14. The tension strainer of claim 13, wherein the first engagement surfaces are angularly disposed surfaces meeting at an apex.

15. The tension strainer of claim 13, wherein the number of first engagement surfaces exceeds the number of second engagement surfaces.

16. The tension strainer of claim 12, wherein the restricting element is a horseshoe-shaped clip.

17. The tension strainer of claim 16, wherein the second engagement surfaces extend from spaced ends of the clip.

18. The tension strainer of claim 17, wherein the first engagement surfaces are disposed above the frame assembly.

19. The tension strainer of claim 12, wherein the drum attachment portion includes two spaced portions, each of the spaced portions having an end with a drum attachment piece attached to each end and formed from a resilient material.

20. A method of adjusting the tension of a snare assembly of a drum, comprising the steps of:

providing a snare tension assembly comprising a frame assembly comprising a frame assembly housing, a drum attachment portion extending from the frame assembly housing, and a bore formed in the frame assembly housing, providing a snare wire assembly holder coupled to a lower end of the frame assembly housing, wherein the snare wire assembly holder is configured to engage snare wires, providing a tension rod disposed within the bore formed in the frame assembly housing, wherein the tension rod is configured to modify tension applied to the snare wires and a plurality of notches are formed in an outer surface of the tension rod, providing an adjusting knob coupled to an upper portion of the tension rod, providing a lever pivotally mounted to the frame assembly, wherein the lever comprises a lever body and a projection that extends substantially perpendicular to the lever body, providing a restricting element operably associate with the projection of the lever, wherein the fastening element is adapted for engaging with the notches formed in an outer surface of the adjusting knob, rotating the tension rod and causing the restricting element engages the notches and the engagement locks the tension rod in position.

* * * * *